US005443598A

United States Patent [19]

Baumann

[11] Patent Number: 5,443,598

[45] Date of Patent: Aug. 22, 1995

[54] DYEING ASSISTANTS AND THEIR USE

[75] Inventor: Hans-Peter Baumann, Ettingen, Switzerland

[73] Assignee: Sandoz Ltd., Basle, Switzerland

[21] Appl. No.: 900,035

[22] Filed: Jun. 17, 1992

[30] Foreign Application Priority Data

Jun. 17, 1991 [DE] Germany ..... 41 19 861.1

[51] Int. Cl.[6] ..... D06P 5/12

[52] U.S. Cl. ..... 8/455; 8/552; 8/606; 8/917; 8/924; 8/901

[58] Field of Search ..... 8/455, 606, 901, 917, 8/924; 252/357, 544, 547, 548

[56] References Cited

U.S. PATENT DOCUMENTS

| | | | |
|---|---|---|---|
| 2,891,835 | 6/1959 | Matter et al. | 8/55 |
| 2,967,755 | 1/1961 | Keller | 8/84 |
| 3,560,142 | 2/1971 | Keller | 8/551 |
| 3,627,475 | 12/1971 | Baumann | 8/54 |
| 3,684,427 | 8/1972 | Walz et al. | 8/590 |
| 4,090,845 | 5/1978 | Petzold et al. | 8/606 |
| 4,149,978 | 4/1979 | Goffinet | 252/8.8 |
| 4,220,449 | 9/1980 | Baumann | 8/606 |
| 4,285,691 | 8/1981 | Egli et al. | 8/455 |
| 4,297,296 | 10/1981 | Baumann | 8/606 |
| 4,411,665 | 10/1983 | Egli et al. | 8/455 |
| 4,852,991 | 8/1989 | Frauenknecht et al. | 8/586 |

FOREIGN PATENT DOCUMENTS

| | | |
|---|---|---|
| 3003192C2 | 8/1980 | Germany . |
| 3222516C2 | 2/1983 | Germany . |
| 3805622A1 | 9/1988 | Germany . |
| 3932869C1 | 1/1991 | Germany . |
| 3932869 | 1/1991 | Germany . |
| 1273656 | 5/1972 | United Kingdom . |
| 1495473 | 12/1977 | United Kingdom . |
| 2102454B | 2/1983 | United Kingdom . |

OTHER PUBLICATIONS

Derwent Abstract of Document #3, DE 39 32 869 C1, Mar. 1991.

*Primary Examiner*—Paul Lieberman
*Assistant Examiner*—Margaret Einsmann
*Attorney, Agent, or Firm*—Robert S. Honor; Richard E. Vila; Andrew N. Parfomak

[57] ABSTRACT

Compositions comprising (a) a cationic surfactant which per se acts as a reserving agent in the dyeing of substrates dyeable with anionic dyes, or a mixture of such surfactants and (b) a cationic surfactant which per se acts as a retarder in the dyeing of polyacrylonitrile with cationic dyes, or a mixture of such surfactants and which may contain further components, are eminently suitable as reserving agents for substrates dyeable with anionic dyes.

13 Claims, No Drawings

DYEING ASSISTANTS AND THEIR USE

In the dyeing and optionally optical brightening of substrates there may be achieved with the use of reserving agents determined colouristic effects, e.g. determined white or colour print effects and/or determined multicolour effects. In doing so, it is essential that the reserving agents hinder the draw-up such as the build-up of the dye or brightener on the substrate and also do not precipitate it, but be able to maintain the dye such as brightener in solution or in dispersion in such a measure as is sufficient for being rinsed away as well as possible from the reserved portion of the substrate in the suitable stage of the process. The efficacy and yield of the agent used for reserving is in this of deciding importance.

It has now been found that by combination of cationic surfactants, which are efficient as reserving agents, with other cationic compounds, as are conventionally employed as retarders for cationic dyes on polyacrylonitrile fibres, there may be achieved surprisingly good reserving effects in high yield on substrates that as such are dyeable with anionic dyes.

The invention relates to this combination of agents and to the use thereof as reserving agent as described below and to corresponding compositions.

The invention thus provides a dyeing assistant comprising (a) a cationic surfactant which per se acts as a reserving agent in the dyeing of substrates dyeable with anionic dyes, or a mixture of such surfactants and (b) a cationic surfactant which per se acts as a retarder in the dyeing of polyacrylonitrile with cationic dyes, or a mixture of such surfactants.

As cationic surfactants (a) come in general into consideration compounds that are known conventionally as reserving agents, principally polyoxyalkylation products of fatty amines, fatty amino(oligo)amines or fatty amide(oligo)amines which may optionally be quaternated, in particular as are described in the German published patent applications DE-OS 30 03 192 and 32 22 516 and in DE 39 32 869 C1, which are incorporated herein by reference.

Reserving agents suitable as (a) correspond in particular to the formula

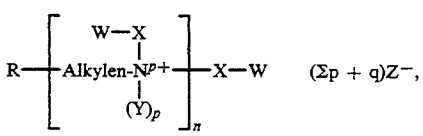

(Ia)

in which R signifies a radical of formula

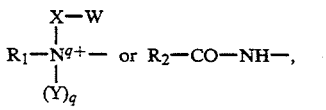

$R_1$ signifies a $C_{10-22}$-fatty radical $R_2$—CO— signifies the acyl radical of a $C_{10-22}$-fatty acid X signifies a radical of the general formula $$\text{—}(A\text{—}O)_m(B\text{—}O)_r, \qquad \text{(g)}$$

A signifies phenylethylene or butylene,

B signifies ethylene or propylene,

Alkylen signifies ethylene or propylene,

Y signifies $C_{1-4}$-alkyl, aryl-($C_{1-3}$-alkyl) or —$CH_2$—CO—$NH_2$,

W signifies hydrogen or $C_{1-4}$-alkyl, n signifies a number from 0 to 4 or, if R signifies $R_2$—CO—NH—, 1 to 4, p signifies 0 or 1, q signifies 0 or 1, m signifies 0 or 1, r signifies 1 to 30 and $Z^-$ signifies an equivalent of an anion and the molecule contains, on the average, 8 to 70 groups —B—O— of which at least 50% are ethyleneoxy units and the molecule contains, on the average, at most three groups —A—O—.

The compounds of formula (Ia) are essentially oxyalkylation products of compounds of formula $$R'\text{—}(\text{Alkylen-NH})_n\text{—}H, \qquad \text{(IIa)}$$

in which R' signifies a radical of the formula $R_1$—NH— or $R_2$—CO—NH—, to compounds of formula

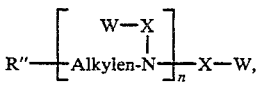

(IIIa)

in which R'' signifies a radical of the formula $R_1$—N(X—W)— or $R_2$—CO—NH—,, which are optionally etherified with $C_{1-4}$-alkyl (as W) and/or are optionally quaternized with Y-yielding quaternizing agents.

The average proportion of ethyleneoxy units in the molecule is advantageously at least 80% of the total of the —B—O— units; with particular advantage all of the units —B—O— are ethyleneoxy units. The sum of the total of the groups —B—O— present on average per molecule of formula (Ia) is advantageously in the range of 12 to 40. The groups —A—O— may be situated in any position of the respective polyglycolether chain (g), e.g. at the beginning (bound to N) or at the end (bound to W) or between two groups —B—O—.

W is preferably hydrogen.

As acyl radicals $R_2$—CO— come, in general, into consideration radicals of conventional fatty acids, in particular of such with 12 to 22 carbon atoms, principally such with 14 to 18 carbon atoms. The acyl radicals of the following fatty acids may, in particular, be mentioned: lauric acid, palmitic acid, myristic acid, oleic acid, stearic acid, behenic acid, arachidic acid and ricinoleic acid and technical mixtures consisting principally of such acids, e.g. tallow fatty acid, hydrated tallow fatty acid, technical oleic acid and coconut fatty acid, and synthetic acids, e.g. isostearic acid. As radicals $R_1$ there may be mentioned the corresponding fatty alkyl or fatty alkenyl radicals respectively.

The index n signifies advantageously 0, 1 or 2, preferably 0 or 1, if R signifies $R_1$—$N^{q+}$(X—W)$(Y)_q$—, or 1 or 2 if R signifies $R_2$—CO—NH—.

The surfactants (a) may be non-quaternary compounds and may optionally be protonated, whereby for protonation there may be employed conventional acids, preferably mineral acids (especially sulphuric acid, hydrochloric acid or phosphoric acid) or low-molecular aliphatic carboxylic acids, principally such with 1 to 4 carbon atoms (in particular formic acid, acetic acid, oxalic acid, maleic acid, citric acid or lactic acid). The components (a) are advantageously at least in part quaternary; the sum $\Sigma p+q$ preferably equals 0.5 to $(n+1)$, especially 1 to $(n+1)$. Preferably the compounds of formula (Ia) are at least partially quaternated, i.e. they contain at least one ammonium group in which p or q is 1. As Y come into consideration principally naphthylmethyl, phenylethyl, benzyl, carbamoylmethyl, ethyl oder methyl, preferably methyl. As anions $Z^-$come principally into consideration such as are introduced by quaternization, in particular chloride, bromide, methosulphate or ethosulphate. The quaternizable amino groups present in the molecule may be quaternized exhaustively or only in part. Advantageously only one or at most two amino groups are quaternated per molecule. I.e. if the molecule contained only one amino group this is preferably quaternated; if the molecule contained 2 to 4 resp. 5 quaternizable amino groups, preferably 1 to 2, thereof on average are quaternated.

The reaction of the compounds of formula (IIa) with the corresponding oxiranes (styrene oxide, butylene oxide, propylene oxide, ethylene oxide) for the introduction of the respective radicals —BO— and optionally —AO— may be carried out in any desired sequence and under reaction conditions conventional per se, preferably at elevated temperature, in particular in the temperature range of from 100° C. to 170° C., and in the presence of a suitable catalyst, in particular of an alkali metal hydroxide (sodium hydroxide, potassium hydroxide, lithium hydroxide); the reaction may be carried out in an inert organic solvent or in the absence of any solvents, suitably with displacement of air oxygen. If styrene oxide and/or butylene oxide are employed as oxyalkylating agents, there are employed advantageously 0.5 to 3 moles thereof, preferentially 1 mole thereof per mole of amine of formula (IIa); the reaction with styrene oxide and/or butylene oxide is carried out advantageously as the first oxyalkylation and may even be carried out without any catalyst. The reaction with propylene oxide and ethylene oxide may, in general, be carried out in any desired sequence; advantageously oxyethylation is carried out first and oxypropylation afterwards. The $C_{1-4}$-alkyl radicals W may be introduced in a manner known per se, e.g. by etherification or transetherification or by introduction of the whole chain —X—W.

For quaternization there may be employed conventional Y-yielding quaternizing agents, in particular aryl-($C_{1-3}$-alkyl)-halides, $C_{1-4}$-alkylhalides (preferably chlorides) or -sulphates (preferably dimethylsulphate or diethylsulphate) or chloroacetic acid amide. The quaternization may take place under conventional reaction conditions, e.g. in the temperature range of from 40° C. to 100° C.

Compounds of the kind (a) are described for instance in the U.S. Pat. Nos. 2 967 755 and 3 627 475, in German patent DE 39 32 869 C1 and in the German published patent applications DE 30 03 192 A1 (≡ U.S. Pat. Nos. 4 285 691 and 4 411 665) and DE 32 22 516 A1 (≡ GB-A 2 102 454). These patents and published patent applications are incorporated herein by reference.

Contrary to the components (a), which, as reserving agents are principally products of relatively low cationic charge density, the components (b) are principally compounds with a relatively high cationic charge density. As charge density there is understood here the number of protonatable protonated and quaternated amino groups present in total per weight unit. Retarders that are suitable here as components (b) are described, e.g. in the following literature: DE-AS 1 092 878, 1 148 971 and 1 160 818, DE-0S 1 469 737, 25 08 242 (≡ U.S. Pat. No. 4 220 449) and 29 24 471 (≡ U.S. Pat. Nos. 4 297 296 and 4 335 259), DE-P 16 43 526 (≡ U.S. Pat. No. 3 560 142), US-P 2 891 835 and "Tenside" - 2 - (1965), no. 3, pages 76–83. These documents are incorporated herein by reference. The retarders (b) are principally aliphatic, in particular open-chain mono- or oligoamines or heterocyclic amines in which all N-bound hydrogen atoms are replaced by $C_{1-4}$-alkyl and/or aryl-($C_{1-3}$-alkyl) and, optionally, one or two $C_{10-22}$-fatty radicals (hydrocarbon radicals) in total and the product is optionally quaternized. Optionally the molecule contains instead of a N-bound hydrocarbon fatty radical a corresponding fatty acid radical, which in the form of the fatty acid amide is bound to the basic or quaternary nitrogen over an alkylene bridge. (b) contains advantageously at least 10, preferably at least 16 carbon atoms, disregarding any counterions. Preferably the molecule contains at least one N-bound aryl-($C_{1-3}$-alkyl)-group.

As compounds (b) come advantageously into consideration the following:

(b'): Quaternization products of mono- or oligoamines of the formula

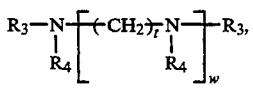

(Ib')

in which each R3 independently signifies a $C_{10-22}$-fatty radical or $R_4$, $R_4$ signifies aryl-($C_{1-3}$-alkyl) or $C_{1-4}$-alkyl, t signifies an integer from 2 to 6 and w signifies 0 or an integer from 1 to 6, or a mixture of such compounds, with the proviso that the cation of the quaternization product contains at least 16 carbon atoms.

(b''): Compounds of the formula

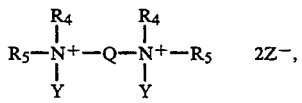

(Ib'')

in which $R_5$ has one of the significances indicated above for $R_3$ or, independently from (a) signifies a radical of the formula R2—CONH-Alkylen, $Z^-$signifies an equivalent of an anion and Q signifies an aliphatic $C_{3-18}$—, preferably $C_{3-10}$—, -hydrocarbon radical, substituted with —OH and/or, if it contains 4–18, preferably 4–10, carbon atoms, is interrupted by oxygen.

(b'''): Compounds of the formula

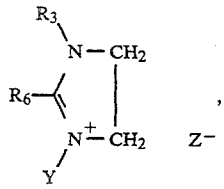

(Ib''')

in which $R_6$ signifies hydrogen or has one of the significances indicated above for $R_3$.

As fatty radicals $R_3$ with 10–22 carbon atoms come in general into consideration conventional hydrocarbon radicals, in particular such as listed above for $R_1$. If the molecule contains two $C_{20-22}$-fatty radicals these may be equal or different. The fatty radicals in the significance of $R_3$ and the fatty radicals $R_1$ may have the same significance or different significances. Preferably in the compounds of formula (Ib'), at least one of the two symbols $R_3$ signifies a radical R4. If, in the formula (Ib') w=2, $R_3$ is advantageously also a $C_{10-22}$-fatty radical.

As aryl in aryl($C_{1-3}$-alkyl) come into consideration in particular naphthyl-α or -β and phenyl, which optionally bears one or two sub which are $C_{1-2}$-alkyl and/or chlorine. As phenyl-($C_{1-3}$-alkyl)-groups there may in particular be mentioned phenylethyl, phenylisopropyl or benzyl, among which phenylethyl and, before all, benzyl are preferred.

As $C_{1-4}$-alkyl radicals in the significance of $R_4$ come into consideration conventional alkyl radicals, as can be introduced by alkylation reactions, in particular methyl, ethyl, n-propyl, isopropyl, n-butyl, isobutyl, sec.butyl or tert.butyl, among which ethyl and, before all, methyl are preferred. Of the total of the radicals $R_4$ occurring in the formula (Ib'), preferably at least one, in particular at least one third of the total of the radicals $R_4$ signifies aryl-($C_{1-3}$-alkyl), advantageously phenyl--($C_{1-3}$-alkyl), most preferably benzyl. With particular advantage, all of the symbols $R_4$ in the compounds (b') signify phenyl-($C_{1-3}$-alkyl), in particular benzyl.

The index t signifies advantageously 2, 3, 4 or 6, preferably 2, 3 or 6, in particular 2 or 3. If w>1, the w indices t may have the same significance or different significances. If w>1, t signifies preferably 2 or 3. The index w signifies preferably 1 to 4, in particular 1 to 3.

In formula (Ib'') Q signifies advantageously a radical of formula $$-CH_2-CHOH-CH_2-(O-T-O-CH_2-CHOH-CH_2)_v- \quad (\beta_1),$$

in which T signifies ethylene or propylene
and v signifies a number from 0 to 3
or of the formula $$-CH_2-CHOH-CHOH-CH_2- \quad (\beta_2)$$

T signifies preferably ethylene. The index v signifies advantageously 0 or 1, with particular preference 0. Among the compounds (b'') preference is given to those in which Q signifies a radical of formula ($\beta_1$) and v=0. Further, among the compounds (b'') are preferred those, in which each of the two symbols $R_5$ signifies a $C_{10-22}$-hydrocarbon radical and, in particular, those in which $R_4$ signifies $C_{1-2}$-alkyl.

The compounds (b) are preferably quaternated. Among the mentioned compounds (b) are preferred the compounds (b'') and, before all, the compounds (b'). The quaternated derivatives of the compounds of formula (Ib') may be represented by the following formula

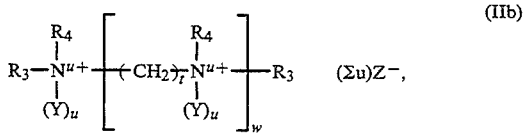

(IIb)

in which Z− signifies an equivalent of an anion,
u signifies 0 or 1
and Σu signifies a number from 1 to (w+1).

Y in the compounds (b') and (b''') advantageously signifies a phenyl--($C_{1-3}$-alkyl) -radical and/or $C_{1-4}$-alkyl-radical, introduced by quaternization as indicated above for formula (Ia). Y in formula (Ia) and in formula (IIb), (Ib'') resp. (Ib''') may have the same significance or different significances. Most preferably Y signifies methyl.

The retarders (b) to be employed according to the invention, may be produced in manner known per se. The compounds (b') may be produced principally by alkylation and/or aralkylation of corresponding aliphatic mono- or oligoamines, in particular of such of formula

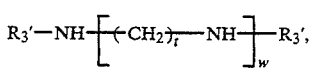

(IIIb)

in which each $R_3'$ independently signifies hydrogen or $R_3$,
with corresponding $R_4$-yielding alkylating resp. aralkylating agents.

If w signifies 0, advantageously at least one of the symbols $R_3$ resp. $R_3'$ signifies a $C_{10-22}$-fatty radical; the second symbol R3' signifies in this case preferably hydrogen, resp. the second symbol $R_3$ signifies in this case preferably $R_4$.

The compounds (b'') can be produced by quaternizing alkylation of compounds of the formula $$R_5\text{-}NYR_4 \quad (\beta_3)$$

with epihalohydrines or diepoxides that are capable of forming bridges —Q—, resp. with intermediate products of the formula

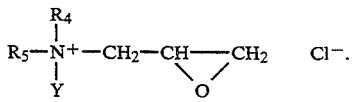

($\beta_4$)

The alkylation resp. aralkylation for the introduction of the radicals $R_4$ may be carried out under conditions known per se, in particular at temperatures in the range of from room temperature (=20° C.) to boiling temperature, preferably 40° to 100° C. (such alkylation or aralkylation reactions may also be exothermic), using corresponding $R_4$-yielding compounds, principally halides (in particular chlorides) or sulphates, in particular naphthylmethyl chloride, benzyl chloride, phenylethyl chloride, methyl or ethyl sulphate or methyl, ethyl, propyl or butyl chloride. The reaction may be carried out in concentrated aqueous medium. When using $R_4$-halide it may be of advantage to use products that cleave or bind acids, e.g. alkali metal hydroxides. The alkylation reaction resp. aralkylation reaction may be carried out in one or more stages and the quaternization [which may be carried out analogously as described above for the compounds (a)] may follow directly thereto. Optionally the compounds (b') may also be protonated, e.g. analogously as described above for (a).

Preferred retarders (b) are in particular such of the kind (b') as described in the examples of German published Patent Application DE 29 24 471 A1, which is incorporated herein by reference, and such of the kind (b'') in which the two symbols $R_5$ have the same significance and stand for $R_2$—CO—NH—Alkylen- or a $C_{10-22}$-fatty radical, the symbols Y and $R_4$ signify each methyl and Q signifies 2-hydroxypropylene-1,3, as they are described in the examples of DE-AS 1 092 878, which is also incorporated herein by reference. Among the compounds (b'), (b'') and (b''') the compounds (b') and (b'') are preferred, especially (b').

Preferred quaternization products of compounds of formula (Ib') are ($b_1$) quaternization products of compounds of formula (Ib'), in which one $R_3$ signifies a $C_{10-22}$-fatty radical and the other signifies $R_4$ and ($b_2$) quaternization products of compounds of formula (Ib') in which both $R_3$ signify $R_4$.

In the compounds ($b_1$) w signifies advantageously 0 to 2, most preferably 1, and t signifies preferably 2 or 3; $R_4$ signifies in this case preferably benzyl and/or $C_{1-4}$-alkyl, at least one $R_4$ signifying benzyl; with particular preference all radicals $R_4$ in ($b_1$) signify benzyl.

In ($b_2$) w signifies preferably 1 to 5, in particular 1 to 3, and if w signifies 2 to 5, t signifies preferably 2 and/or 3. According to a particularly preferred aspect of the invention, all radicals $R_4$ in ($b_2$) signify benzyl.

Advantageously (b) is ($b_2$) or a mixture of ($b_2$) with ($b_1$) [although it is also possible to use ($b_1$) alone].

Essentially the dyeing assistants of the invention are mixtures of (a) with (b). The weight ratio a:b is advantageously in the range of 1:9 to 9:1, preferably 1:9 to 7:3, in particular 1:4 to 2:1, mixtures a/b in the weight ratio $<1:1$, especially in the range of 1:3 to 1:1, being particularly preferred.

If (b) is a mixture of ($b_1$)+($b_2$) the weight ratio ($b_2$):[(a)+($b_1$)+($b_2$)] is advantageously in the range of 5% to 70%, preferably 10% to 45%.

The dyeing assistants of the invention are advantageously formulated to compositions that contain further additives, in particular (c) a non-ionic surfactant or surfactant mixture (d) a buffer for setting the pH of liquid formulations, preferably to pH-values in the range of 4.5 to 10

(e) a defoamer and/or (f) a preserving agent (e.g. a fungicide).

As non-ionic surfactants (c) come principally into consideration O/W-emulsifiers, advantageously such with an HLB in the range of 8 to 18, preferably 12 to 17 and in which the lipophilic radical contains preferably 9 to 24, in particular 10 to 22 carbon atoms, e.g. oxyethylation products of fatty alcohols, fatty acids or fatty acid amides, of fatty acid mono- or diesters of aliphatic polyfunctional alcohols (in particular of glycerol, sorbitan or sorbitol), e.g. of fatty acid mono- or diglycerides or of fatty acid sorbitan mono- or diesters, or further of hydroxygroup-containing natural oils (e.g. of castor oil) or of alkyl-substituted phenols, in which alkyl contains 3 to 18 carbon atoms and the alkyl-substituted phenyl radical contains in total 9 to 24 carbon atoms [e.g. mono- or dipropylphenol, mono- or dibutylphenol or mono- or di-($C_{6-12}$-alkyl)-phenol]. The number of added ethyleneoxy units is suitably chosen so, as to achieve the desired HLB. The component (c) is advantageously present at least then, when the composition contain aralkylated products (b), in particular ($b_2$).

As buffers (d), there may be used any per se conventional compounds, in particular inorganic salts, mainly sodium, potassium and/or ammonium salts of inorganic polyvalent mineral acids (principally sulphuric acid and phosphoric acid) or monoalkalimetal salts of polybasic organic carboxylic acids (e.g. of oxalic acid or tartaric acid).

As defoamers (e) there may be employed conventional products, e.g. on the basis of hydrophobic silica, paraffin waxes, mineral oils, silicones and/or alkylenediamine fatty acid bisamides.

Advantageously the compositions of the invention that contain at least (a) and (b) and which may optionally contain further additives as indicated above, are formulated in the form of aqueous concentrated compositions, which advantageously have a dry substance content of 5 to 70% by weight, preferably 10 to 60% by weight. Component (c) may then be employed in concentrations of advantageously up to 200% by weight, preferably 5 to 100% by weight, referred to (a)+(b). Components (a) and (b) and the optional further additives are advantageously mixed with each other in aqueous medium so that there may directly be obtained aqueous compositions. If both (a) and (b') are quaternated products, the respective compounds of formulae (IIIa) and (Ib') may also be quaternized in admixture with each other, preferably at temperatures in the range of 40° to 100° C. and advantageously upon separation of a possible aqueous phase.

It is also possible to dry the aqueous compositions, e.g. by evaporation of the water and to ship and use them as dry products.

The compositions of the invention serve as reserving agents in the dyeing and/or optical brightening processes, in which substrates dyeable with anionic dyes are treated with anionic dyes or optical brighteners, wherein by local application of the dyeing assistant of the invention before and/or after the application of the dye or optical brightener, there are obtainable white or coloured pattern effects or/and multicolour effects.

As substrates, that are dyeable with anionic dyes, come into consideration, in general, any such substrates, in particular textile and non-textile fibrous material of natural or regenerated cellulose or of natural or synthetic polyamides (e.g. wool, silk, leather or synthetic polyamides) or polyurethanes, which may optionally be dyed or optically brightened. Preferably the process of the invention is employed on natural and/or in particular synthetic polyamides, optionally blended with cellulosic fibres and/or non-dyeable polypropylene fibres. The substrates may be in any form suitable for the process of the invention, e.g. as filaments, yarns, skeins, hanks, woven or knitted goods, non-wovens, non-woven webs, felts and, in particular, open-pile or looped pile material (carpets, tuftings, velvet or terry cloth).

The anionic dyes or optical brighteners (Fa), which, by the process of the invention, are hemmed in their build-up on the substrate or, if they have already been applied on the substrate, may be removed from the substrate by subsequent application of the reserving agent in a wet-in-wet-process, are in particular such with a $K'_{pH6}>5$, preferably $>6.5$. This K' value is a value conventional in tinctorial chemistry; for its determination reference is made, e.g. to GB-Patent I 489 456 or to BAYER-Farbenrevue 21 (1972), pages 32–48 (in particular 42–48), or to MELLIAND-Textilberichte 6 (1973), page 641. If desired, for ground dyeings or brightenings and for over-dyeings or -brightenings or also in the liquor or paste that contains the reserving agent, there may be employed anionic dyes or optical brighteners (Fb) with clearly lower $K'_{pH6}$-values, in particular of $K'_{pH6}<5$, preferably $<4$, which are practically not influenced by the employed reserving agent. The ground dyeings or brightenings and overdyeings resp. -brightenings with anionic dyes or optical brighteners (Fa) and/or (Fb) may be carried out by any impregnation methods conventional per se (e.g. by padding, dipping, application with a rod, foam application, spraying, pouring on or printing) and may be fixed by steaming. If there is carried out a ground-dyeing or brightening with anionic dyes resp. brighteners (Fa) which has to be modified by means of the reserving agent, it is preferably carried out by impregnation with aqueous liquors or pastes, and may subsequently be treated with the reserving agent in a wet-in-wet-process.

For the local treatment of the substrate the reserving agent is suitably applied in the form of a preferably aqueous liquor or paste that contains the reserving agent of the invention and may contain further additives foreseen for the respective dyeing process, e.g. nonionic or weakly anionic surfactants, additions for setting the pH (e.g. acids, e.g. as listed above, or buffer-salts, e.g. as listed above), thickeners (e.g. locust bean gum, tragacanth gum, arabic gum, dextrine or synthetic polymers, as they are, in general, commercially available as thickeners), flow assistants and/or, if desired, anionic optical brighteners or dyes (Fb), and the pH of which is advantageously in the range of 4.5 to 10 [without optical brightener or dye (Fb), advantageously pH 5 to 9, with optical brightener or dye (Fb), advantageously pH 4.5 to 8]. The compositions containing the reserving agents may be applied by conventional methods, in order to locally form the patterns, e.g. by printing (e.g. by means of stencil printing, rotational film printing, embossed cylinder printing, spray printing), by dripping or by superficial treatment of tuftings or knitted goods (e.g. for the knit-de-knit process) or further by ink-jet printing application. The reserving compositions contain the reserving agents of the invention in such a concentration that an efficient reserving may be achieved, in particular such a quantity that in the paste or liquor there are contained advantageously 0.2 to 12 g, preferably 0.4 to 5.5 g of the reserving agent (a) per kg of paste or liquor; according to the invention it is possible to achieve with a surprisingly small amount of reserving agent (a) a good reserving effect, in particular with less than 4 g of reserving agent (a) per kg paste or liquor, or even with less than 2 g of reserving agent (a) per kg of paste or liquor [in this it is to be taken into consideration that, depending on the substrate, on the tendering of the dye to be reserved on the substrate by means of the assistant, on the applied method and on the desired reserving effect, the quantity of (a) may be reduced correspondingly].

The fixation of the reserving-agent-containing liquor or paste on the substrate takes place advantageously by treatment with saturated steam, conveniently at a temperature above 95° C., preferentially at 98° to 110° C. The fixation time can be maintained in conventional limits, e.g. from 30 seconds to 20 minutes, depending on the chosen fixation method, advantageously 2 to 8 minutes. On the substrate treated with the reserving-agent--containing composition there may be applied, suitably before the a liquor or paste that contains at least one anionic dye or optical brightener, the sites treated with the composition containing the reserving agent being reserved against dyes resp. optical brighteners (Fa), whereas anionic dyes and optical brighteners (Fb) are practically not influenced by the reserving agent. The (Fa)-containing liquors or pastes applied on the reserved substrates are advantageously aqueous and are advantageously applied by impregnation methods (e.g. as listed above); the pH-values and temperatures therefor, as well as the composition of such dye-liquors or pastes, may be in conventional ranges. Thereafter there is suitably carried out the fixation as indicated above.

By skilled choice of dyes, optical brighteners and pattern, resp. application method and sequence of dyeing and reserving, a large selection of white and colour patterns and multicolour effects is thus available.

By the process of the invention there may be achieved outstanding reservation effects, even on high pile substrates, in high yield and optimum clarity and sharpness of outlines, the tinctorial properties of the respective dyes and the fastnesses and brilliancy of the dyeings not being negatively influenced.

In the following Examples parts and percentages are by weight, the temperatures are indicated in degrees Celsius. The indicated dye concentrations refer to pure dye in salt form, the dyes are employed in a blended form, in which Glauber's salt (sodium sulphate) and/or sodium chloride are used as blending agents, as conventional for the respective commercial dyes.

Example 1

The following reserving agents (a) are employed, which are obtainable by reaction of the respective amines of the formula (IIa) with the indicated oxiranes and optionally quaternization, analogously as described in GB Patent 1 006 787 (e.g. in Example VI).

TABLE 1

| (a) | 1 Mole of amine of formula (IIa) | Number of moles: Styrene oxide | Ethylene oxide | Propylene oxide | Quaternizing agent (number of moles) |
|---|---|---|---|---|---|
| a1 | $R_x—NH_2$ | 1 | 15 | — | Dimethylsulphate (1) |
| a2 | $R_x—NH_2$ | 1.5 | 25 | — | Dimethylsulphate (1) |
| a3 | $R_x—NH_2$ | 1 | 15 | — | Dimethylsulphate (1) |
| a4 | $R_x—NH_2$ | 1 | 20 | — | Dimethylsulphate (1) |
| a5 | $R_w—NH_2$ | 2 | 20 | 1 | Dimethylsulphate (1) |
| a6 | $R_z—NH_2$ | — | 25 | — | Dimethylsulphate (1) |
| a7 | $R_x—NH(CH_2)_3NH_2$ | 2 | 20 | — | Dimethylsulphate (1) |
| a8 | $R_x—NH_2$ | 2 | 25 | — | Benzylchloride (1) |
| a9 | $R_x—NH_2$ | 2 | 25 | — | Benzylchloride (0.5) |

TABLE 1-continued

| (a) | 1 Mole of amine of formula (IIa) | Number of moles: Styrene oxide | Ethylene oxide | Propylene oxide | Quaternizing agent (number of moles) |
|---|---|---|---|---|---|
| a10 | $R_y—NH_2$ | — | 35 | — | Dimethylsulphate (1) |
| a11 | $R_x—NH(CH_2)_3NH_2$ | 3 | 25 | — | Benzylchloride (1) |
| a12 | $R_x—NH(CH_2)_3NH_2$ | 2 | 15 | 3 | Dimethylsulphate (2) |
| a13 | $R_y—CO—NH(CH_2)_3NH_2$ | 2 | 20 | — | Dimethylsulphate (2) |
| a14 | $R_y—CO—NH(CH_2)_3NH_2$ | 1 | 15 | — | Dimethylsulphate (1) |
| a15 | $R_y—NH(CH_2)_2NH_2$ | 3 | 25 | — | Dimethylsulphate (1) |
| a16 | $R_y—CO—NH(CH_2)_2NH_2$ | 2 | 20 | — | Dimethylsulphate (1) |
| a17 | $R_y—NH_2$ | 2 | 15 | — | Dimethylsulphate (1) |

$R_x$ = 1% $C_{12}H_{25}$;, 14% $C_{14}H_{29}$, 31% $C_{16}H_{33}$, 24% $C_{18}H_{37}$ and 40% $C_{18}H_{35}$;
$R_y$ = Oleyl,
$R_y—CO$ = Oleoyl,
$R_w$ = 3% $C_8H_{17}$, 6% $C_{10}H_{21}$, 56% $C_{12}H_{25}$, 18% $C_{14}H_{29}$, 10% $C_{16}H_{33}$; 2% $C_{18}H_{37}$ and 2% $C_{18}H_{35}$;
$R_z$ = 1.3% $C_{14}H_{29}$, 4.7% $C_{16}H_{33}$, 42% $C_{18}H_{37}$, 12% $C_{20}H_{41}$ and 40% $C_{22}H_{45}$.

There are employed the following components (b), which are produced as indicated in the reference literature, indicated in Table 2, in admixture with non-ionic surfactants (c), with the exception of b36 and b37.

TABLE 2

| | |
|---|---|
| b21 | Product of synthetic Example 1 of DE 25 08 242 C3 |
| b22 | Product of synthetic Example 2 of DE 25 08 242 G3 |
| b23 | Product of synthetic Example 3 of DE 25 08 242 C3 |
| b24 | Product of synthetic Example 4 of DE 25 08 242 C3 |
| b25 | Product of synthetic Example 5 of DE 25 08 242 C3 |
| b26 | Product of Example 1 of DE 29 24 471 A1 |
| b27 | as b26 but using the amine $H_2N(CH_2)_3NH(CH_2)_2NH_2$ instead of N,N'-bis(3-aminopropyl)ethylenediamine |
| b28 | as b26 but using the amine $H_2N(CH_2)_3NH(CH_2)_3NH(CH_2)_2NH(CH_2)_3NH_2$ instead of N,N'-bis(3-aminopropyl)ethylenediamine |
| b29 | as b26 but using the amine $H_2N(CH_2)_3NH(CH_2)_3NH(CH_2)_2NH(CH_2)_3NH(CH_2)_3NH_2$ instead of N,N'-bis(3-aminopropyl)ethylenediamine |
| b31 | Product according to Example 2 of DE 29 24 471 A1 |
| b32 | as b31 but using the amine $H_2N(CH_2)_3NH(CH_2)_2NH_2$ instead of N,N'-bis(3-aminopropyl)ethylenediamine |
| b33 | as b31 but using the amine $H_2N(CH_2)_3NH(CH_2)_3NH(CH_2)_2NH(CH_2)_3NH_2$ instead of N,N'-bis(3-aminopropyl)ethylenediamine |
| b34 | as b31 but using the amine $H_2N(CH_2)_3NH(CH_2)_3NH(CH_2)_2NH(CH_2)_3NH(CH_2)_3NH_2$ instead of N,N'-bis(3-aminopropyl)ethylenediamine |
| b35 | Product according to Example 2 appendix (page 8, lines 1-6) of DE 29 24 471 Al |
| b36 | Product of Example 3 of DE-AS 1 092 878 |
| b37 | N,N-Dimethyl-N-benzyl-tallowammonium chloride |

Composition R1

36 parts of an aqueous 35% solution of a1 are admixed with 24 parts of water-free product b31 and with 40 parts of demineralized water.

Composition R1-bis

The non-quaternated intermediates of a1 and b31 are admixed with each other and then, analogously as described in DE 29 24 471 A1, Example 2, they are quaternized with the required amount of dimethylsulphate at 95° C., treated with the iso-octylphenolpoly(10)-glycolether and then set with demineralized water to a dry substance content of 56%.

Compositions R2 to R17

The procedure described for Composition R1 is repeated, with the difference, that in place of a1 there is employed the same amount of each of the reserving agents a2 to a17.

Compositions R18 to R32

The procedure described for Composition R1 is repeated, with the difference that instead of the product b31, there are employed each of the products b21, b22, b23, b24, b25, b26, b27, b28, b29, b32, b33, b34, b35, b36 and b37.

Composition R33

The procedure described for Composition R1 is repeated, with the difference that a6 is admixed with b25 and with water.

Composition R34

The procedure described for Composition R33 is repeated, with the difference, that in place of b25 there is employed the same amount of b26.

Application Example A

A polyamide-6-carpet (uni-cut-loop) with groundweb (primary backing) of polypropylene is padded with an aqueous liquor that contains in 1000 parts the following components:

4 parts of the dye C.I. Acid Black 222
4 parts of a commercially available thickening agent on locust bean gum basis
2 parts of a non-ionic dispersant (addition product of higher alkylphenol and ethylene oxide - commercial product)
1 part of 60% acetic acid to a pick-up of 120% referred to the dry weight and then locally printed (wet-in-wet) with an aqueous printing paste that contains in 1000 parts the following components:

14 parts of Composition R1
20 parts of a commercially available thickening agent on the basis of locust bean gum by means of a film-printing stencil and then fixed during 6 minutes with saturated steam at 100° C. The treated goods are then rinsed, dehydrated and dried. There is obtained a floor carpet which is dyed in a level black shade and patterned in white.

Application Example B

Application Example A is repeated, with the difference that the local pattern printing is carried out with a printing paste that contains in 1000 parts 7 parts of Composition R1

20 parts of a commercially available thickening agent on locust bean gum basis 0.6 parts of the dye C.I. Acid Orange 156

1 part of 60% acetic acid, upon which, as described in Application Example A, fixation is carried out during 6 minutes with saturated steam at 100° C. and the goods are then rinsed, dehydrated and dried. There is obtained a floor carpet dyed in a level black shade and patterned in orange.

Application Example C

A loop-pile carpet (uni-loop-pile) of polyamide-6 with a ground-web (primary backing) of polypropylene, is locally printed with an aqueous printing paste that contains in 1000 parts the following components:

14 parts of Composition R1

20 parts of a commercially available thickening agent on the basis of locust bean gum.

and then wetted by pouring on an aqueous liquor that contains in 1000 parts the following components:

0.7 parts of the dye C.I. Acid Yellow 235

4 parts of a commercially available thickening agent on the basis of locust bean gum 4 parts of a non-ionic dispersing agent (addition product of ethylene oxide to a higher alkylphenol - commercially available)

1 part of 60% acetic acid in a liquor-to-goods ratio of 5:1 and then fixed during 6 minutes with saturated steam at 100° C. and then rinsed, dehydrated and dried. There is obtained a floor carpet evenly dyed in a yellow shade and patterned in white.

Application Example D

Application Example C is repeated with the difference that for the printing there is employed an aqueous printing paste that contains in 1000 parts the following components:

7 parts of Composition R1

20 parts of a commercially available thickening agent on the basis of locust bean gum 0.7 parts of the dye C.I. Acid Blue 324:1

1 part of 60% acetic acid.

There is obtained a floor carpet evenly dyed in yellow and patterned in blue.

Application Example E

A wool-carpet (uni-cut-loop) with a ground-web (primary backing) of polypropylene is locally printed with a printing paste that contains in 1000 parts the following components:

20 parts of Composition R1

20 parts of a commercially available thickening agent on the basis of locust bean gum and then wetted by pouring on an aqueous liquor that contains in 1000 parts the following components:

1 part of the dye C.I. Acid Orange 168

4 parts of a commercially available thickening agent on locust bean gum basis 4 parts of a non-ionic dispersing agent (addition product of ethylene oxide to a higher alkylphenol - commercially available)

1 part of 60% acetic acid, in a liquor-to-goods ratio of 6:1 and then fixed during 8 minutes in saturated steam at 100° C., then rinsed, dehydrated and dried. There is obtained a floor carpet evenly dyed in an orange shade and patterned in white.

Application Example F

Application Example E is repeated with the difference that for the printing there is employed an aqueous printing paste that contains in 1000 parts the following components:

10 parts of the Composition R1

10 parts of commercially available thickening agent on locust bean gum basis 0.7 parts of the dye C.I. Acid Blue 288

2 parts of 60% acetic acid.

There is obtained a floor carpet evenly dyed in orange and patterned in blue.

Analogously as the composition R1 each of the compositions R1-bis to R34 are employed in the above Application Examples A to F.

I claim:

1. A dyeing assistant for the treatment with anionic dyes or optical brighteners of substrates that are dyeable with anionic dyes comprising:

(a) a cationic surfactant which acts as a reserving agent in the dyeing of substrates dyeable with anionic dyes, which is a polyoxyalkylated and quaternized fatty amine, fattyamino(oligo)amine or fattyamido(oligo)amine or a mixture of such surfactants and, (b) a cationic surfactant which acts as a retarder in the dyeing of polyacrylonitrile with cationic dyes, which is selected from the group consisting of:

(b') at least one compound of the formula:

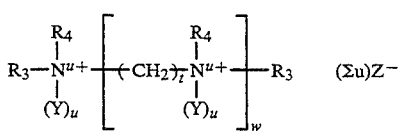

(IIb)

in which each $R_3$ independently signifies a $C_{10-22}$-fatty radical or $R_4$, $R_4$ signifies aryl-($C_{1-3}$alkyl) or $C_{1-4}$-alkyl, Y signifies aryl-($C_{1-3}$-alkyl) or $C_{1-4}$-alkyl, t signifies an integer from 2 to 6, and, w signifies 0 or an integer from 1 to 6, and if w=0, one $R_3$ signifies a $C_{10-22}$-fatty radical and the other $R_3$ signifies $R_4$, $Z^-$signifies an equivalent of an anion, u signifies 0 or 1 and,

Σu signifies a number from 1 to (w+1)

or a mixture of such compounds, with the proviso that the cation of the quarternization product of formula (b') contains at least 16 carbon atoms;

(b'') a compound of the formula:

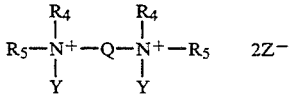

(Ib'')

in which $R_4$ signifies aryl-($C_{1-3}$alkyl) or $C_{1-4}$-alkyl,

Y signifies aryl-($C_{1-3}$-alkyl) or $C_{1-4}$-alkyl, $R_5$ signifies a $C_{10-22}$-fatty radical, an aryl-($C_{1-3}$-alkyl) radical, a $C_{1-4}$-alkyl radical or a radical of the formula $R_2$—CON-H—Alkylen, where $R_2$ is an acyl radical of a $C_{12-22}$ fatty acid, and where, Alkylen signifies ethylene or propylene, $Z^-$signifies the equivalent of an anion, Q signifies an aliphatic $C_{3-18}$ hydrocarbon radical, substituted with -OH or if it contains 4–18 carbon atoms, signifies an aliphatic $C_{3-18}$ hydrocarbon radical interrupted by oxygen and substituted with -OH; or a mixture of such compounds;

and, (b''') compounds of the formula

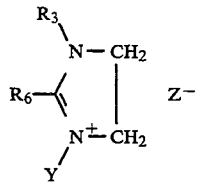

(Ib''')

in which $R_3$ signifies a $C_{10-22}$ fatty radical or aryl-($C_{1-3}$ -alkyl) or $C_{1-4}$ -alkyl $R_6$ signifies hydrogen or has one of the significances of $R_3$, or a mixture of such compounds, or a mixture of such surfactants.

2. A dyeing assistant according to claim 1, wherein (a) corresponds to the formula

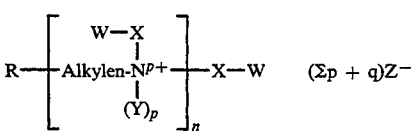

(Ia)

in which R signifies a radical of formula

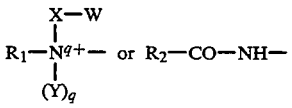

$R_1$ signifies a $C_{10-22}$-fatty radical $R_2$—CO— signifies the acyl radical of a $C_{10-22}$-fatty acid and, X signifies a radical of the general formula A signifies phenylethylene or butylene, B signifies ethylene or propylene Alkylen signifies ethylene or propylene, Y signifies ($C_{1-4}$-alkyl, aryl $C_{1-3}$-alkyl)

W signifies hydrogen ($C_{1-4}$-alkyl)

n signifies a number from 0 to 4 or, if R signifies $R_2$—CO—NH, n is 1 to 4, p signifies 0 or 1, q signifies 0 or 1, m signifies 0 or 1, r signifies 1 to 30, and, $Z^-$signifies an equivalent of an anion and the molecule contains, on the average, 8 to 70 groups —B—O— of which at least 50% are ethyleneoxy units and the molecule contains, on the average, at most three groups 13 A—O—.

3. A dyeing assistant according to claim 1 wherein (b) is a mixture of ($b_1$) at least one quarternization product of at least one compound of formula (IIb) in which one $R_3$ signifies a $C_{10-22}$-fatty radical and the other signifies $R_4$ and ($b_2$) at least one quarternization product of at least one compound of formula (IIb) in which both $R_3$ signify $R_4$.

4. A dyeing assistant according to claim 1 which essentially consists of a mixture of: (a) and (b).

5. A dyeing assistant composition according to claim 1 which further comprises a further additive constitutent selected from the group consisting of:

(c) a non-ionic surfactant or surfactant mixture, (d) a buffer for setting the pH of liquid formulations, (e) a defoamer and (f) a preserving agent.

6. A dyeing assistant composition according to claim 1

(a) is a composition according to the formula (Ia)

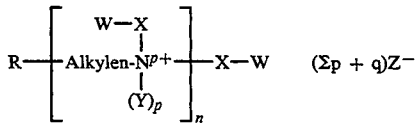

(Ia)

in which R signifies a radical of formula

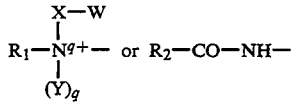

$R_1$ signifies a $C_{10-22}$-fatty radical $R_2$—CO— signifies the acyl radical of a $C_{10-22}$-fatty acid, X signifies a radical of the general formula

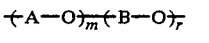

A signifies phenylethylene or butylene,

B signifies ethylene or propylene,

Alkylen signifies ethylene or propylene,

Y signifies $C_{1-4}$-alkyl, aryl-($C_{1-4}$-alkyl) or —$CH_2$—CO—$NH_2$,

W signifies hydrogen or $C_{1-4}$-alkyl, n signifies a number from 0 to 4 or, if R signifies $R_2$—CO—NH, n is 1 to 4, p signifies 0 or 1, q signifies 0 or 1, m signifies 0 or 1, r signifies 1 to 30, and, $Z^-$signifies an equivalent of an anion and, the molecule contains, on the average, 8 to 70 groups —B—O— of which at least 50% are ethyleneoxy units and the molecule contains, on the average, at most three groups —A—O— and (b') at least one compound of the formula:

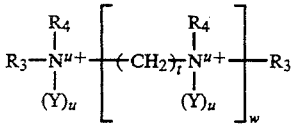

(IIb)

in which each $R_3$ independently signifies a $C_{10-22}$-fatty radical or $R_4$, $R_4$ signifies aryl-($C_{1-3}$-alkyl) or $C_{1-4}$-alkyl, Y signifies aryl-($C_{1-3}$-alkyl) or $C_{1-4}$-alkyl, t signifies an integer from 2 to 6, and, w signifies 0 or an integer from 1 to 6, and if w=0, one $R_3$ signifies a $C_{10-22}$-fatty radical and the other $R_3$ signifies $R_4$, $Z^-$signifies an equivalent of an anion, u signifies 0 or 1 and, Σu signifies a number from 1 to (w+1), or a mixture of such compounds, with the proviso that the cation of the quartemization product of formula (b') contains at least 16 carbon atoms.

7. A dyeing assistant according to claim 1 comprising:

a cationic surfactant which acts as a reserving agent in the dyeing of substrates dyeable with anionic dyes, which is a polyoxyalkylated and quaternized fatty amine, fattyamino(oligo)amine or fattyamido(oligo)amine or a mixture of such surfactants and, (b') at least one quarternization product of a mono- or oligoamine of the formula:

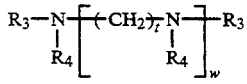

in which;

each $R_3$ independently signifies a $C_{10-22}$-fatty radical or $R_4$, $R_4$ signifies aryl-($C_{1-3}$-alkyl) or $C_{1-4}$alkyl, t signifies an integer from 2 to 6, and, w signifies 0 or an integer from 1 to 6, and if w=0, one $R_3$ signifies a $C_{10-22}$-fatty radical and the other $R_3$ signifies $R_4$, or a mixture of such compounds, with the proviso that the cation of the quarternization product of formula (b') contains at least 16 carbon atoms.

8. A dyeing assistant according to claim 1 comprising:

(a) a polyoxyalkylated and quaternized fatty amine, fattyamino(oligo)amine or fattyamido(oligo)amino and, (b') one or more compounds of the formula (IIB):

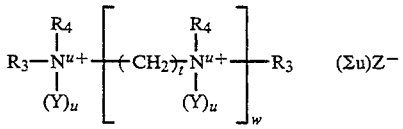

(IIb)

in which each $R_3$ independently signifies a $C_{10-22}$-fatty radical or $R_4$, $R_4$ signifies aryl-($C_{1-3}$-alkyl) or $C_{10-22}$-alkyl, Y signifies aryl-($C_{1-3}$-alkyl) or $C_{1-4}$-alkyl, t signifies an integer from 2 to 6, and, w signifies 0 or an integer from 1 to 6, and if w=0, one $R_3$ signifies a $C_{10-22}$-fatty radical and the other $R_3$ signifies $R_4$, $Z^-$signifies an equivalent of an anion, u signifies 0 or 1 and, Σu signifies a number from 1 to (w+1), with the proviso that the cation of the quarternization product of formula (b') contains at least 16 carbon atoms.

9. A dyeing assistant according to claim 1 comprising:

(a) a polyoxyalkylated and quaternized fatty amine, fattyamino(oligo)amine or fattyamido(oligo)amine and, (b''') one or more compounds of the formula (Ib'''):

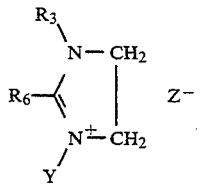

(Ib''')

in which $R_3$ signifies a $C_{10-22}$ fatty radical or aryl-($C_{1-3}$-alkyl) or $C_{1-4}$-alkyl $R_6$ signifies hydrogen or has one of the significances of $R_3$, or a mixture of such compounds.

10. A process for the dyeing or optical brightening of substrates dyeable with anionic dyes, wherein a dyeing assistant according to claim 5 is locally applied to the substrate before or after application of a dye or an optical brightener.

11. A process for the dyeing or optical brightening of substrates dyeable with anionic dyes, wherein a dyeing assistant according to claim 1 is locally applied to the substrate before or after application of a dye or an optical brightener.

12. A process according to claim 11 wherein a polyamide-containing substrate is employed.

13. A process for dyeing or optically brightening a substrate dyeable with anionic dyes according to claim 11 which process comprises the steps of:

(1) locally printing the substrate with an aqueous liquor or paste comprising said dyeing assistant, (2) subsequently contacting the substrate with an anionic dye or optical brightener with a $K'_{pH6}>5$ or a mixture of such dyes or mixture of such optical brighteners, and (3) thereafter fixing and subsequently rinsing the substrate to remove the aqueous liquor or paste comprising the dyeing assistant.

* * * * *